US010605032B2

(12) United States Patent
Ayres et al.

(10) Patent No.: US 10,605,032 B2
(45) Date of Patent: Mar. 31, 2020

(54) ELECTRICALLY INSULATED TUBING HANGER SYSTEM

(71) Applicant: GE Oil & Gas Pressure Control LP, Houston, TX (US)

(72) Inventors: Ana Karoline Ayres, Calgary (CA); Kwong-Onn Chan, Calgary (CA)

(73) Assignee: GE Oil & Gas Pressure Control LP, Houston, TX (US)

( * ) Notice: Subject to any disclaimer, the term of this patent is extended or adjusted under 35 U.S.C. 154(b) by 110 days.

(21) Appl. No.: 15/644,381

(22) Filed: Jul. 7, 2017

(65) Prior Publication Data

US 2018/0010409 A1 Jan. 11, 2018

Related U.S. Application Data

(60) Provisional application No. 62/359,864, filed on Jul. 8, 2016.

(51) Int. Cl.

| | |
|---|---|
| ***E21B 17/00*** | (2006.01) |
| ***E21B 33/04*** | (2006.01) |
| ***E21B 43/12*** | (2006.01) |
| ***E21B 43/24*** | (2006.01) |

(52) U.S. Cl.

CPC ..... *E21B 33/04* (2013.01); *E21B 17/003* (2013.01); *E21B 43/128* (2013.01); *E21B 43/2401* (2013.01)

(58) Field of Classification Search

CPC ..... E21B 33/04; E21B 17/003; E21B 43/128; E21B 43/2401

See application file for complete search history.

(56) References Cited

U.S. PATENT DOCUMENTS

| | | | | |
|---|---|---|---|---|
| 4,291,768 | A * | 9/1981 | Diehl | F16J 15/185 166/378 |
| 4,771,832 | A * | 9/1988 | Bridges | E21B 33/0422 166/380 |
| 4,923,006 | A | 5/1990 | Hartmann et al. | |
| 8,181,970 | B2 | 5/2012 | Smith | |
| 2004/0089444 | A1 | 5/2004 | Demny et al. | |
| 2007/0137863 | A1 | 6/2007 | Khazanovich et al. | |

FOREIGN PATENT DOCUMENTS

| | | |
|---|---|---|
| CA | 2897686 | 1/2016 |
| WO | 2016/149811 | 9/2016 |

OTHER PUBLICATIONS

International Search Report and Written Opinion issued in connection with corresponding PCT Application No. PCT/US2017/041379 dated Nov. 24, 2017.

Chan, K.O., et al., Electrically Insulated Tubing Hanger for Supplying Electrical Energy to Tubing in a Well, GE Co-Pending U.S. Appl. No. 62/190,912, filed Jul. 10, 2015.

* cited by examiner

*Primary Examiner* — Taras P Bemko
*Assistant Examiner* — Dany E Akakpo
(74) *Attorney, Agent, or Firm* — Hogan Lovells US LLP

(57) ABSTRACT

Embodiments of the present disclosure include a system for transmitting electrical energy to a downhole tool including a tubing head. The system also includes a tubing hanger coupled to the tubing head, the tubing head receiving a downward force transmitted by at least a section of tubing coupled to the tubing hanger onto a load shoulder formed in the tubing head. The system includes one or more insulating features for electrically isolating the tubing hanger from the tubing head.

18 Claims, 6 Drawing Sheets

ELECTRICALLY INSULATED TUBING HANGER SYSTEM

CROSS REFERENCE TO RELATED APPLICATIONS

This application claims priority to and the benefit of, U.S. Provisional Application Ser. No. 62/359,864, titled "Electrically Insulated Tubing Hanger for Supplying Electrical Energy to Tubing in a Well," filed Jul. 8, 2016, the full disclosure of which is hereby incorporated herein by reference in its entirety for all purposes.

BACKGROUND

1. Field of Invention

This disclosure relates in general to oil and gas tools, and in particular, to systems and methods for electrically insulating tubing hangers at a wellhead.

2. Description of the Prior Art

In oil and gas production, various components may be arranged at a wellhead to facilitate exploration and recovery of hydrocarbons. These components may include a tubing head arranged downhole of a blowout preventer (BOP). The tubing head receives a tubing hanger, which generally rests on a shoulder of the tubing head to transfer a load from the hanger to the tubing head. For instance, the tubing hanger may suspend production tubing into a wellbore. Generally, the tubing head and tubing hanger are in direct contact, thereby transmitting both electrical energy and mechanical forces. During exploration and recovery operations, downhole tools such as pumps, headers, motors, and the like may utilize electrical power provided by one or more electrical cables extending into the well bore. These power cables may be costly due to the downhole environment, which may include fluids, high temperatures, or high pressures. It is now recognized that improved downhole power transmission systems are desirable.

SUMMARY

Applicants recognized the problems noted above herein and conceived and developed embodiments of systems, according to the present disclosure, for downhole power transmission.

In an embodiment a system for electrically isolating a wellbore assembly of a wellbore includes a tubing head having a bore and a load shoulder. The system also includes a tubing hanger positioned within the bore of the tubing head, the tubing hanger transferring at least a portion of its downward force onto the load shoulder. The system also includes a tubing head adapter securing the tubing hanger within the bore of the tubing head, the tubing head adapter removably coupled to the tubing head. The system includes one or more insulating features arranged between the tubing hanger and the tubing head to block contact between the tubing hanger and the tubing head. The one or more insulating features include a load ring positioned between the tubing hanger and the load shoulder of the tubing head, the load ring receiving the downward force of the tubing hanger. The one or more insulating features also includes a wear ring positioned radially between the tubing head and the tubing hanger, the wear ring being seated in a recess formed in the tubing hanger. The one or more insulating features include a retaining ring arranged below the load ring, the retaining ring extending radially outward from a groove formed in the tubing hanger and contacting the tubing head.

In another embodiment a system for transmitting electrical energy in a wellbore includes a tubing head. The system also includes a tubing hanger positioned on the tubing head, the tubing head holding the tubing hanger on a load shoulder to receive a downward force from tubing coupled to the tubing hanger. The system includes a tree assembly fluidly coupled to the tubing hanger, the tree assembly comprising one or more valves to isolate the wellbore. The system also includes one or more insulating features arranged to electrically isolate the tubing hanger from the tubing head. The one or more insulating features include a load ring positioned between the tubing hanger and the load shoulder of the tubing head, the load ring receiving the downward force of the tubing hanger and electrically isolating the tubing hanger from the tubing head. The one or more insulating features also includes a wear ring positioned radially between the tubing head and the tubing hanger, the wear ring being seated in a recess formed in the tubing hanger. The one or more insulating features include a tubing head filler positioned radially between the tubing head and the tubing hanger, the tubing head filler positioned upstream of the load ring and the wear ring and electrically isolating the tubing hanger from the tubing head.

In an embodiment a system for transmitting electrical energy to a downhole tool includes a tubing head. The system also includes a tubing hanger coupled to the tubing head, the tubing head receiving a downward force transmitted by at least a section of tubing coupled to the tubing hanger onto a load shoulder formed in the tubing head. The system includes one or more insulating features for electrically isolating the tubing hanger from the tubing head. The one or more insulating features include a load ring positioned between the tubing hanger and the load shoulder of the tubing head, the load ring receiving the downward force of the tubing hanger. The one or more insulating features also includes a wear ring positioned radially between the tubing head and the tubing hanger, the wear ring being seated in a recess formed in a large diameter portion of the tubing hanger arranged upstream of the load ring, the large diameter portion having a reverse taper that substantially conforms to a profile of the load ring to thereby transmit the downward force to the load ring.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE INVENTION

Figure 1:
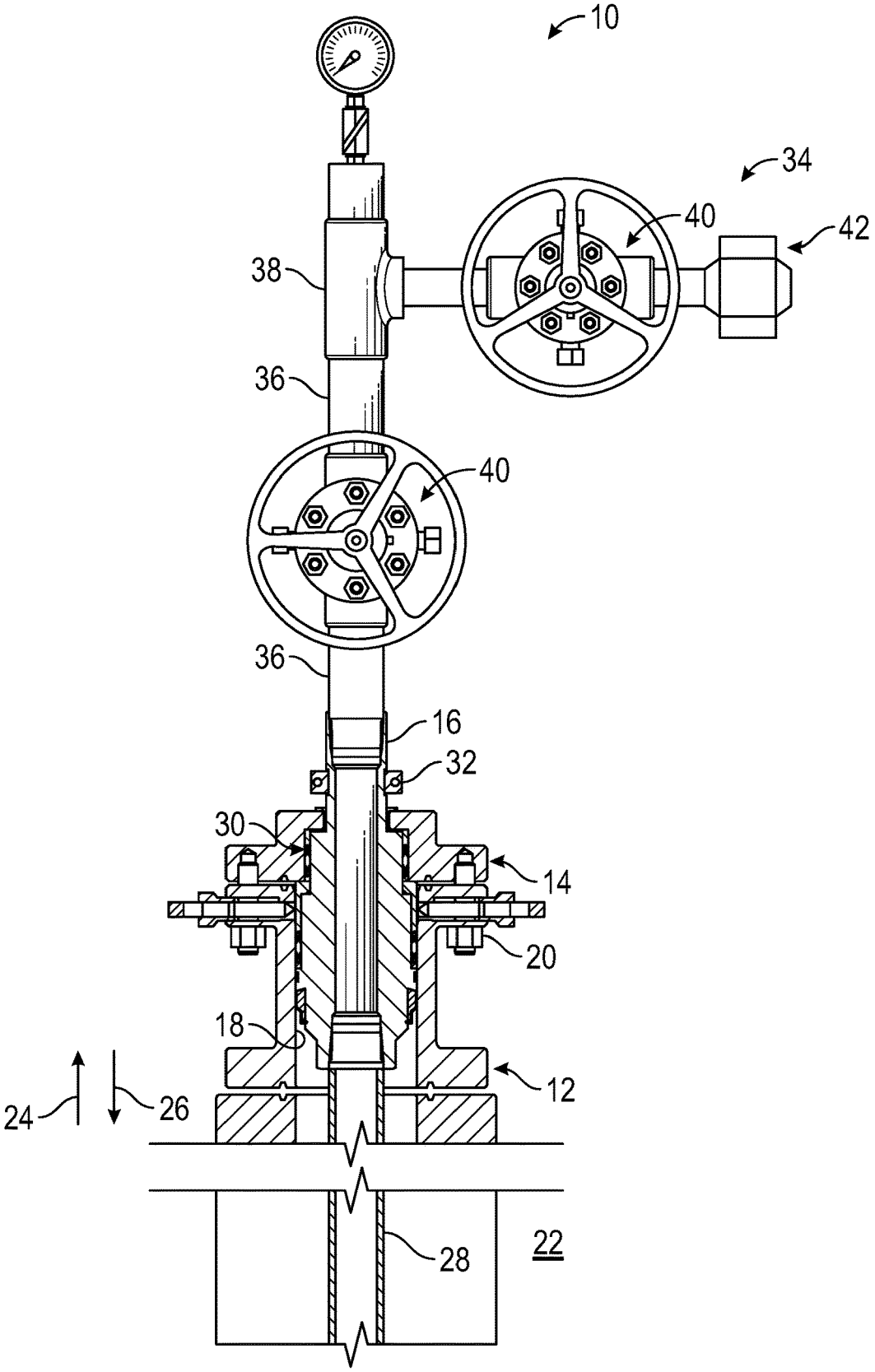
FIG. 1 is a schematic cross-sectional side elevational view of an embodiment of a wellhead assembly having an electrically insulated tubing hanger system, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure are directed toward an electrically insulated tubing hanger system. In certain embodiments, electrical power may be transmitted to downhole tools via downhole tubing, casings, or the like. These downhole transmission systems may be electrically coupled to equipment at the surface, such as a wellhead assembly. Embodiments of the present disclosure include one or more insulating features to electrically isolate the tubing and/or casing from components of the wellhead assembly. For example, the wellhead assembly may include a tubing head and tubing head adapter. The tubing head may receive a tubing hanger to suspend the downhole tubing into the wellbore. In embodiments, the tubing hanger is arranged with insulating features about a circumference of the tubing hanger to provide electrical isolation between the tubing hanger and the tubing head. For instance, insulating features such as an adapter ring, adapter filler, unitized seal, tubing head filler, wear ring, load ring, and/or retaining ring may be positioned between portions of the tubing hanger and wellhead assembly to thereby electrically isolate the tubing hanger from components of the wellhead assembly. As such, electrical energy directed downhole through the tubing hanger will be isolated from other components of the wellhead assembly. Moreover, in embodiments where the electrical energy is directed through the casing, the tubing hanger will also be isolated. In certain embodiments, one or more isolation spools with certain insulating features may be arranged proximate the wellhead assembly to electrically isolate components of the wellhead assembly from downstream components, such as pipelines and tanks. In this manner, electrical energy may be transmitted downhole without electrically energizing components of the wellhead assembly.

FIG. 1 is a schematic side elevational view of an embodiment of a wellhead assembly 10. It should be appreciated that certain components of the wellhead assembly, such as the blowout preventer (BOP), various instrumentation systems, and the like have been omitted for clarity. Additionally, while embodiments of the present disclosure may be described with reference to hydrocarbon recover in the oil and gas industry, the embodiments disclosed herein may be utilized in other industries involving underground exploration and production or above ground power transmission. The illustrated wellhead assembly 10 includes a tubing head 12 coupled to a tubing head adapter 14. The tubing head adapter may be utilized to secure a tubing hanger 16 arranged within a bore 18 of the tubing head 12. For example, in the illustrated embodiment, the tubing head 12 is positively coupled to the tubing head adapter 14 via fasteners 20 (bolts in the illustrated embodiment) to thereby resist pressures from a formation 22 in an upstream direction 24 from driving the tubing hanger 16 out of the bore 18.

The tubing hanger 16 extends in a downstream direction 26 into the bore 18 to support tubing 28 coupled to the tubing hanger 16. As used herein, the upstream direction 24 refers to flow out of the wellbore and the downstream direction 26 refers to flow into the wellbore. This tubing 28 may be production tubing, completion tubing, or any other type of wellbore tubular utilized in oil and gas exploration and production. As will be described in detail below, the illustrated embodiment includes one or more insulating features 30 to thereby electrically insulate the tubing hanger 16 from other components of the wellhead assembly 10, such as the tubing head 12 or the tubing head adapter 14. During oil and gas production operations, the tubing hanger 16 may be arranged in direct contact with the tubing head 12 and/or the tubing head adapter 14. These components are often formed from metallic or electrically conductive materials and thereby transmit electrical energy. This transmission of energy may be undesirable when personnel are working at or near the wellhead assembly 10. As such, the systems disclosed herein described one or more features to electrically insulate the tubing hanger 16 from components of the wellhead assembly 10 to thereby facilitate transmission of electrical energy via the tubing 28 to components arranged downhole. For example, in certain embodiments, electrical energy may be transmitted to the tubing 28 via brackets 32 arranged on the tubing hanger 16.

In the embodiment illustrated in FIG. 1, the wellhead assembly 10 also includes a tree assembly 34 including piping 36, fittings 38, valves 40, and the like, such as instrumentation. It should be appreciated that as used herein piping 36 and tubing 28 may be formed by substantially the same components. Additionally, in the illustrated embodiment, the tree assembly 34 includes an isolation spool 42. As will be described below, in embodiments where electrical energy is transmitted to the tubing 28, such energy may also be transmitted along the tree assembly 34, which may be coupled to a pipeline. In order to electrically isolate the tree assembly 34 from the pipeline, the isolation spool 42 may be arranged between the tree assembly 34 and the pipeline to block electrical energy from energizing the pipeline.

Figure 2:
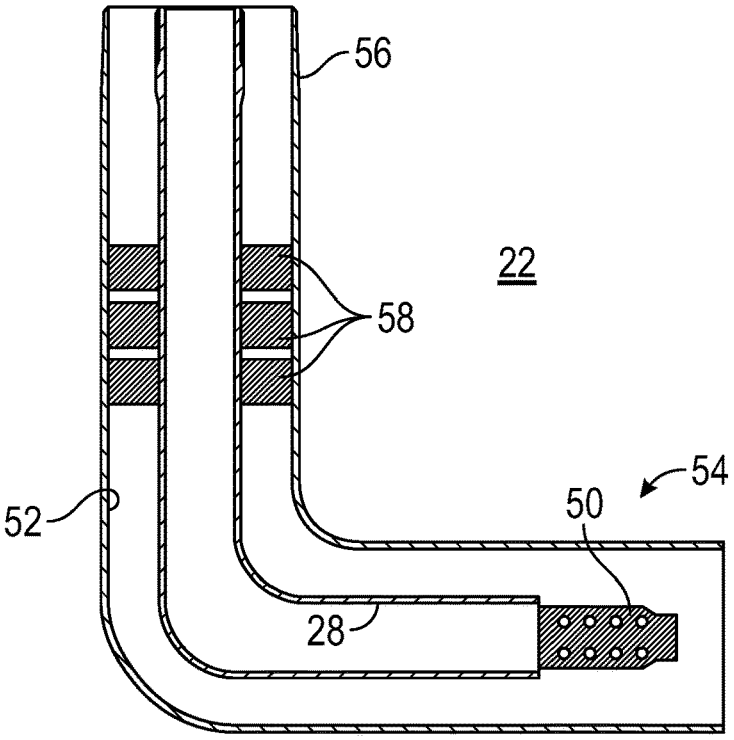
FIG. 2 is a schematic side elevational view of an embodiment of an oil and gas operation using an electric submersible pump, in accordance with embodiments of the present disclosure.

FIG. 2 is a schematic side view of an embodiment of an electric submersible pump (ESP) 50 arranged in a wellbore 52. In the illustrated embodiment, the wellbore 52 is a deviated wellbore 52 with a horizontal leg 54, casing 56, and packers 58 arranged between the tubing 28 and the casing 56. In operation, the ESP 50 may receive electrical energy from the tubing 28 to facilitate operation. As will be described below, the electrical energy provided to the tubing 28 at the surface may be low voltage. However, as would be understood by one skilled in the art, electrical resonance enables the generation of higher voltage and currents than those fed into a system. As a result, the low surface energy may be utilized to power the ESP 50.

Figure 3:
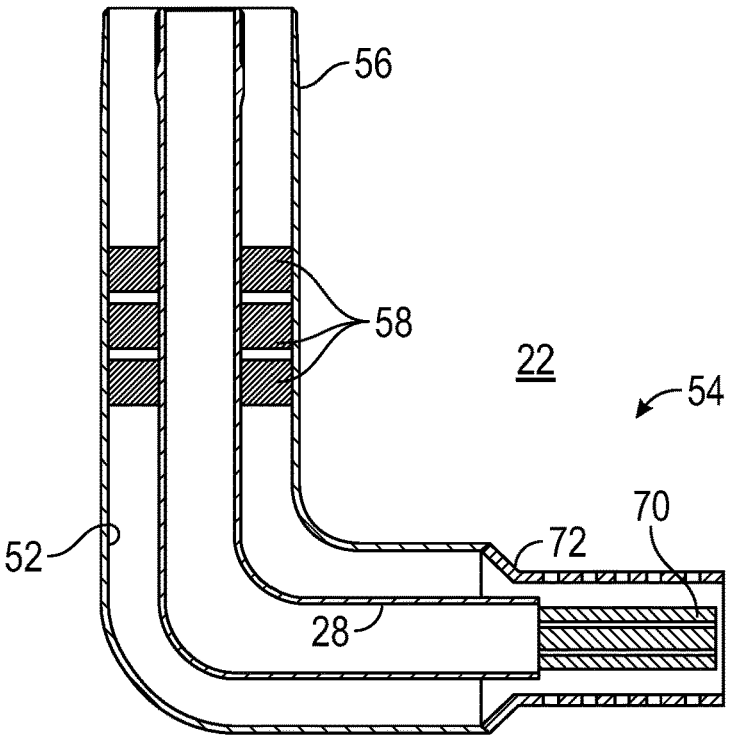
FIG. 3 is a schematic side elevational view of an embodiment of an oil and gas operation using a heater, in accordance with embodiments of the present disclosure.

FIG. 3 is a schematic side view of an embodiment of a heater 70 arranged in the wellbore 52 proximate a slotted line 72. As described above with respect the FIG. 2, the heater 70 may be arranged in the horizontal leg 54. During operation, the heater 70 may receive electrical energy from the tubing 28 and transmit the energy to the formation 22. For example, heating the formation 22 may improve the flow characteristics of recoverable hydrocarbons through the slotted line 72.

Figure 4:
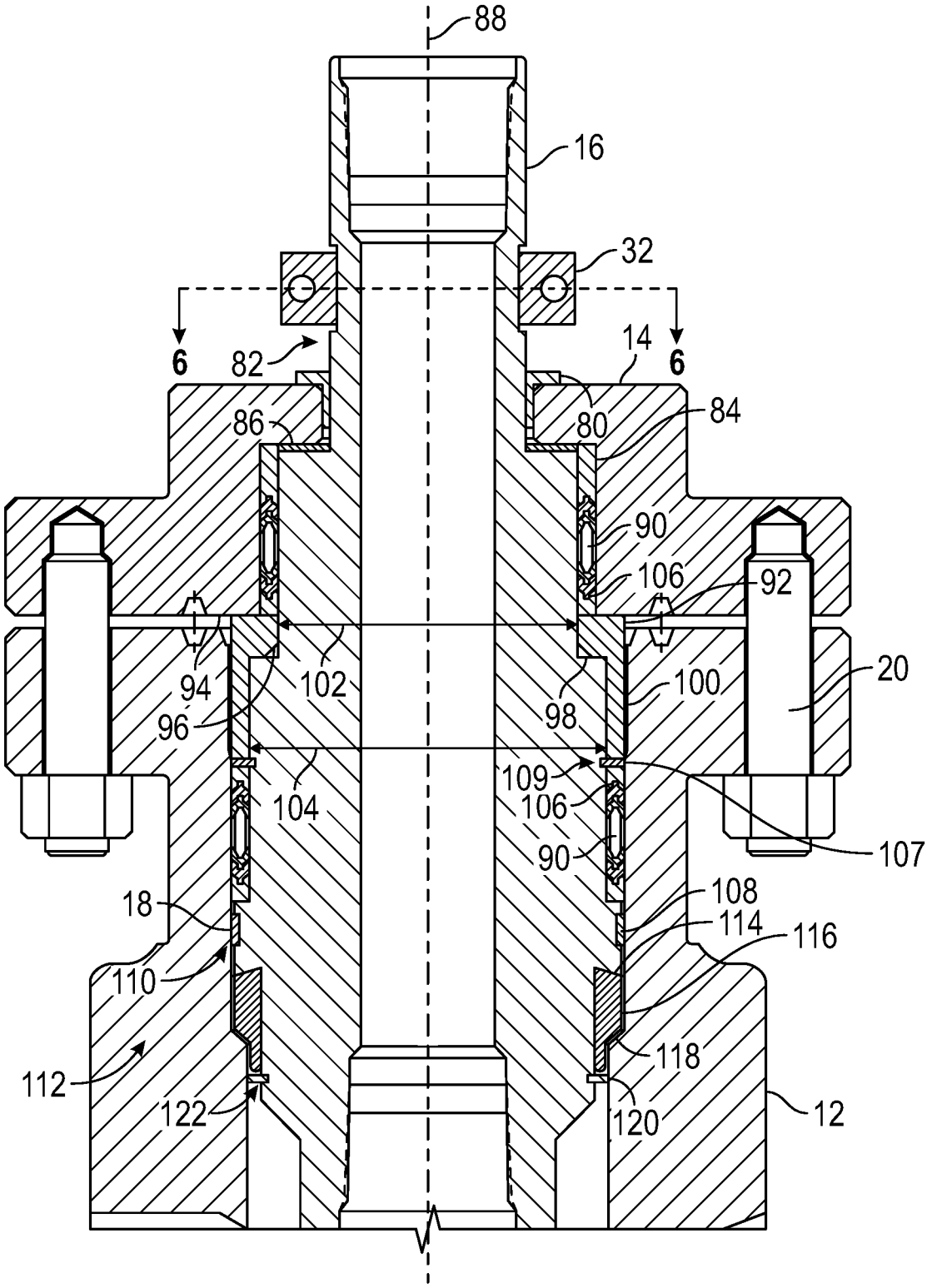
FIG. 4 is a schematic cross-sectional side elevational view of an embodiment of an electrically insulated tubing hanger system, in accordance with embodiments of the present disclosure.

FIG. 4 is a cross-sectional side elevational view of the tubing hanger 16 arranged within the bore 18 of the tubing head 12. As will be described below, the insulating features 30 are positioned to electrically isolate the tubing hanger 16 from the tubing head 12 and the tubing head adapter 14. In the illustrated embodiment, the bracket 32 is arranged proximate the tubing head adapter 14 to introduce electrical energy to the tubing hanger 16 from an external source, such as a generator or power grid.

The illustrated embodiment includes several insulating features 30. In embodiments, the insulating features 30 may be formed from one or more insulating and/or nonconductive materials. Non-limiting example materials include Teflon™, polytetrafluoroethylene (PTFE), polyether ether ketone (PEEK), glass-filled polymers (e.g., glass-filled PEEK), rubber, fiberglass, porcelain, ceramic, plastics, and the like. In the illustrated embodiment, an adapter ring 80 is arranged between the tubing hanger 16 and the tubing head adapter 14. The adapter ring 80 may be an annular ring or a split ring (e.g., split annular ring) that is installed after the BOP is removed. As illustrated, an inner diameter of the adapter ring 80 is larger than the outer diameter of the proximate tubing hanger 16 portion, thereby blocking the tubing hanger from contacting the tubing head adapter 14. In other words, a diameter of a hole 82 of the tubing head adapter 14 is larger than at least a portion of an outer diameter of the adapter ring 80, thereby electrically isolating the tubing hanger 16 from the tubing head adapter 14. Moving in the downstream direction 26, an adapter filler 84 is positioned below a downward facing shoulder 86 of the tubing head adapter 14. In the illustrated embodiment, the adapter filler 84 abuts the downward facing shoulder 86, as will be described below, thereby blocking the tubing hanger 16 from moving axially along an axis 88 and into contact with the tubing head adapter 14. For example, upward forces acting on the tubing hanger 16 may be transmitted to the adapter filler 84, which is driven upward toward the tubing head adapter 14 and blocks contact between the tubing hanger 16 and the tubing head adapter 14. In certain embodiments, the adapter filler 84 is an annular ring made of Teflon™ that may be installed after the BOP is removed. It should be appreciated that the adapter filler 84 may be composed of other nonconductive materials. Downstream of the adapter filler 84 sits a unitized seal 90, which is also nonconductive. The unitized seal 90 blocks radial movement of the tubing hanger 16, along with certain other insulating features 30, to thereby electrically insulate the tubing hanger 16 from the tubing head adapter 14. As shown, an inner diameter of the unitized seal 90 is larger than an a proximate tubing hanger 16 outer diameter, thereby blocking contact between the tubing hanger 16 and the tubing head 12. Furthermore, the unitized seal 90 may block or limit radial movement of the tubing hanger 16. In certain embodiments, the unitized seal 90 is installed after the BOP is removed.

Continuing in the downstream direction 26, a tubing head filler 92 is arranged below a bottom 94 of the tubing head adapter 14 and may abut or be in contact with the tubing head adapter 14. As a result, upstream forces applied to the tubing hanger 16 will be transmitted to the tubing head filler 92 via a load shoulder 96 arranged over an upward facing shoulder 98 of the tubing hanger 16. Accordingly, movement of the tubing hanger 16 in the upstream direction 24 is substantially blocked, thereby maintaining electrical isolation of the tubing hanger 16 from one or more other wellhead assembly 10 components. In the illustrated embodiment, the tubing head filler 92 is arranged between at least a portion of the tubing hanger 16 and the tubing head 12. Moreover, as shown in FIG. 4, there is a gap 100 between an outer diameter of the tubing head filler 92 and an inner diameter of the tubing head 12, proximate the tubing head filler 92. In certain embodiments, the gap 100 is arranged to receive collected fluids or gas. For example, in certain embodiments, the one or more insulating features 30 may not be pressure sealing components. As a result, there may be fluid and/or gas ingress between the tubing hanger 16 and the tubing head 12. The gap 100 enables collection of the fluid and/or gas and keeps the fluid and/or gas away from the electrically conductive tubing hanger 16. In operation, the tubing head filler 92 may be a substantially annular and installed after the BOP is removed.

In the embodiment illustrated in FIG. 4, the tubing head filler 92 includes a first inner diameter 102, the load shoulder 96, and a second inner diameter 104. As shown, the first and second inner diameters 102, 104 are larger than the proximate outer diameter of the hanger 16, thereby isolating the hanger 16 from the tubing head 12. In certain embodiments, the tubing head filler 92 includes chevron shaped ends 106 to facilitate connection to the unitized seals 90 arranged upstream and downstream of the tubing head filler 92. In certain embodiments, the chevron shaped ends 106 may be separate from the tubing head filler 92 and be installed after the BOP is removed. Additionally, as illustrated in FIG. 4, a retaining ring 107 is arranged within a groove 109 formed in the tubing hanger 16. As illustrated, the retaining ring 107 is positioned above the unitized seal 90 and keeps the unitized seal in place during installation and/or removal operations.

In the illustrated embodiment, a wear ring 108 is positioned in a recess 110 formed in a large diameter portion 112 of the tubing hanger 16. As will be described below, the recess 110 includes a reverse taper 114 to enable expansion of the wear ring 108, for example, due to external pressures. In certain embodiments, the wear ring 108 may be a Moly-Gard™ ring. As will be appreciated, an outer diameter of the wear ring 108 is larger than an outer diameter of the large diameter portion 112, thereby blocking contact between the tubing hanger 16 and the tubing head 12. In certain embodiments, the wear ring 108 is a split right that expands and contracts into place as the wear ring 108 is installed on the tubing hanger 16.

Continuing in the downstream direction 26, a load ring 116 is arranged below the large diameter portion 112 of the hanger 16. As shown, the reverse taper 14 is arranged above the load ring 116. In the embodiment illustrated in FIG. 4, the load ring 116 is positioned on a shoulder 118 of the tubing head 12. This shoulder 118 receives a force from the weight of the tubing hanger 16 positioned in the bore 18. That is, the load ring 116 is subjected to a force in the downstream direction 26 and bears against the shoulder 118. In the illustrated embodiment, an inner diameter of the load ring 116 is larger than an outer diameter of a proximate portion of the tubing hanger 16, thereby separating and electrically insulating the tubing hanger 16 and tubing head 12. As a result, electrical power directed to the tubing hanger 16 via the bracket 32 is not transmitted to the tubing head 12. In certain embodiments, the load ring 116 is an annular ring that is installed with the tubing hanger 16 through the BOP.

In the illustrated embodiment, a retaining ring 120 is arranged downstream of the load ring 116 and positioned within a groove 122 formed in the tubing hanger 16. This retaining ring 120 is utilized to hold the load ring 116 in place during installation. That is, gravitational forces may drive the load ring 116 in the downstream direction 26 during installation, the retaining ring 120 blocks the load ring 116 from sliding off of the tubing hanger 16. In certain embodiments, the retaining ring 120 extends radially outward to contact the tubing head 12, thereby insulating the tubing hanger 16 from the tubing head 12.

Figure 5:
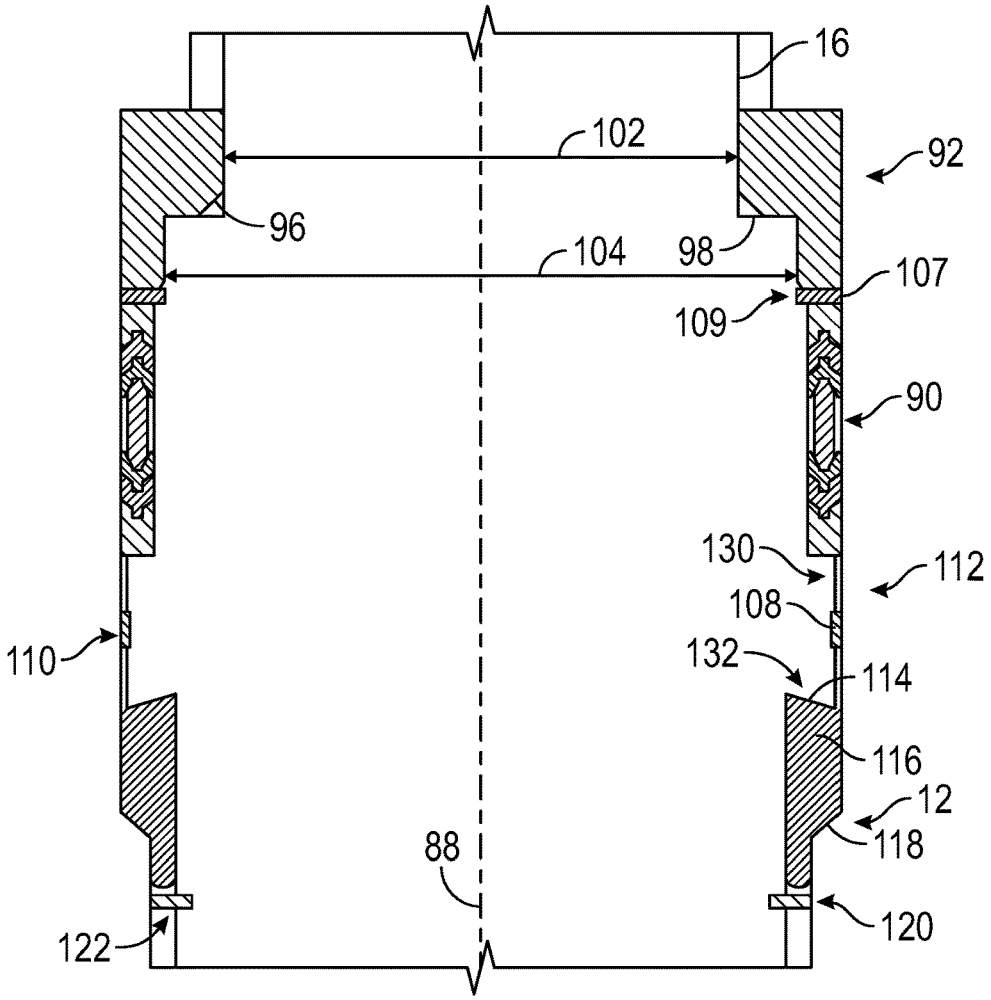
FIG. 5 is a detailed schematic cross-sectional side elevational view of an embodiment of an electrically insulated tubing hanger system, in accordance with embodiments of the present disclosure.

FIG. 5 is a cross-sectional schematic side elevational view of an embodiment of the tubing hanger 16 including the one or more insulating features 30 to electrically isolate the tubing hanger 16 from the tubing head 12 and/or the tubing head adapter 14, among other components of the wellhead assembly 10. The illustrated embodiment includes the unitized seal 90 arranged upstream of the large diameter portion 112. As shown, the large diameter portion 112 includes a first section 130 and a second section 132 having the recess 110 arranged therebetween. The recess 110 receives the wear ring 108 having a larger outer diameter than an outer diameter of the first and second sections 130, 132. As a result, the wear ring 108 is positioned in contact with the tubing head 12 and the large diameter portion 112 is not. In this manner, the tubing hanger 16 is electrically isolated from the tubing head 12.

As described above, the large diameter section 112 includes the reverse taper 114 on the second section 132. The reverse taper 114 provides additional area between the large diameter section 112 and the shoulder 118 that is occupied by the load ring 116, thereby providing a larger area over which to distribute the forces. Additionally, as illustrated in FIG. 5, the retaining ring 120 is arranged within the groove 122 to block downstream movement of the load ring 116. Furthermore, in embodiments, the retaining ring 120 assists with limiting radial movement of the tubing hanger 16, thereby blocking contact between the tubing hanger 16 and the tubing head 12.

Figure 6:
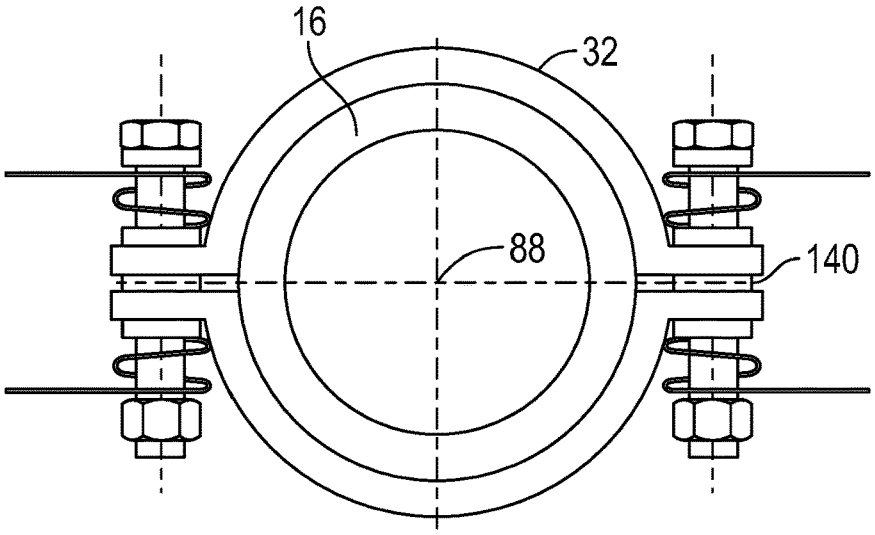
FIG. 6 is a schematic top plan view of an embodiment of an electrically insulated tubing hanger system taken along line 6-6, in accordance with embodiments of the present disclosure.

FIG. 6 is a schematic top plan view taken along line 6-6. FIG. 6 illustrates the bracket 32 arranged about the tubing hanger 16 thereby transmit electrical energy directed to the bracket 32. In the illustrated embodiment, the bracket 32 includes clamps 140 to enable a circumferential and coaxial arrangement of the bracket 32 relative to the tubing hanger 16. As shown, the bracket 32 is in direct contact with the tubing hanger 16. In certain embodiments, both components are formed of a conductive material, such as metal. Therefore, electrical energy provided to the bracket 32 is transmitted to the tubing hanger 16, which is subsequently transmitted to the tubing 28 and downhole tools coupled to the tubing 28, such as the ESP 50 or the heater 70.

Figure 7:
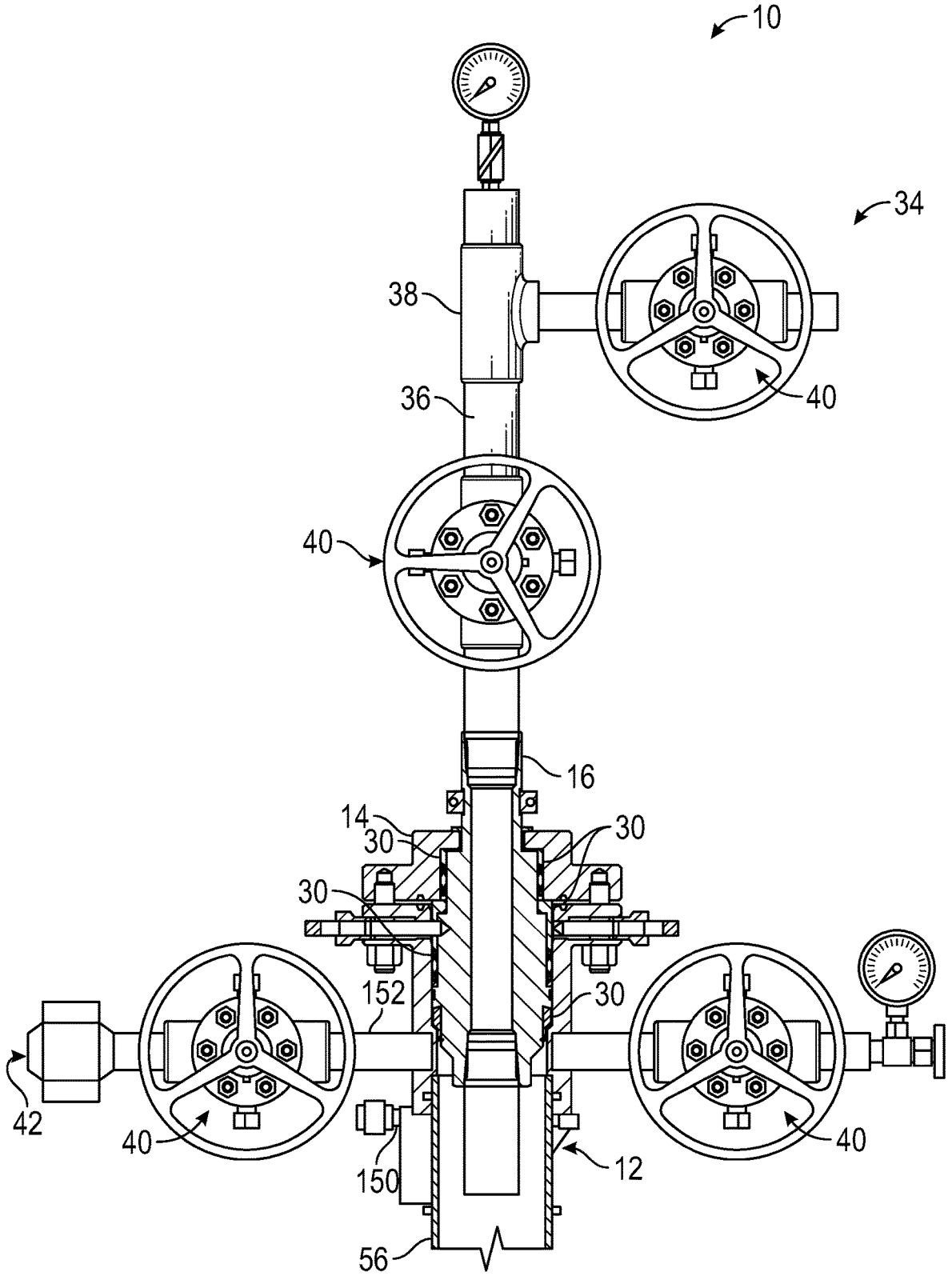
FIG. 7 is a schematic cross-sectional side elevational view of an embodiment of an electrically insulated tubing hanger system, in accordance with embodiments of the present disclosure.

FIG. 7 is a schematic side elevational view of an embodiment of the wellhead assembly 10 in which electrical energy is transmitted to the casing 56. As described above, the tubing head 12 receives the electrically isolated tubing hanger 16, the isolation provided by the insulating features 30. In the illustrated embodiment, an electrical inlet 150 is arranged proximate an outlet 152. The electrical inlet extends through the tubing head 12 and to the casing 56. In certain embodiments, the casing 56 may be in contact with the tubing head 12, thereby transmitting electrical energy to the tubing head 12. However, the tubing hanger 16 remains isolated due to the insulating features 30 and thereby prevents transmission of the electrical energy to the tree assembly 34. In the illustrated embodiment, the isolation spool 42 is positioned proximate the outlet 152. In certain embodiments the outlet 152 may be coupled to a pipeline or tank, and therefore, the isolation spool 42 blocks the transmission of electrical energy from the casing 56 to the pipeline.

Figure 8:
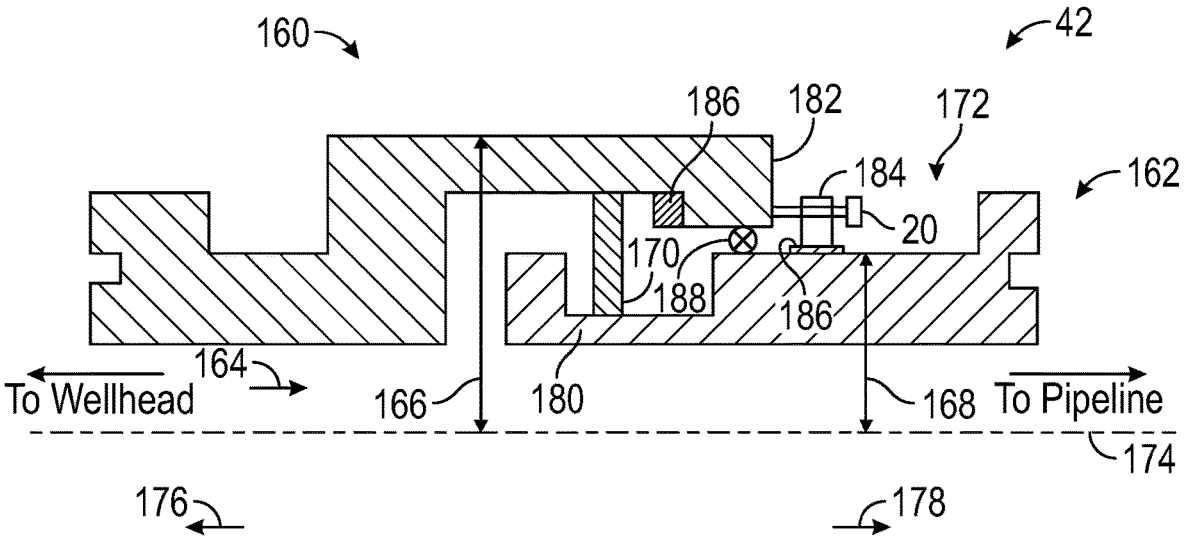
FIG. 8 is a schematic cross-sectional side elevational view of an embodiment of an isolation spool, in accordance with embodiments of the present disclosure.

FIG. 8 is a partial cross-sectional schematic side view of an embodiment of the isolation spool 42. As described above, the isolation spool 42 may be arranged between the wellhead assembly 10 and associated equipment, such as pipelines or tanks, to thereby isolate electrical energy at the wellhead from the associated equipment. In the illustrated embodiment, the isolation spool 42 includes a first part 160 (the wellhead side) and at a second part 162 (the pipeline side). As shown, a common throughbore 164 extends through the first part 160 and the second part 162 to facilitate transmission of fluids (e.g., gas, liquid, solids, or a combination thereof). It should be appreciated that in certain embodiments the throughbore 162 may have a variable or changing diameter between the transition of the first part 160 and the second part 162. Flanges are arranged on respective ends to facilitate coupling to components at the well site. The first part 160 has an outer diameter 166 that is larger than an outer diameter 168 of the second part 162 and is arranged such that the second part 162 is nested within the first part 160. As will be described below, the isolation spool 42 includes one or more features to facilitate expansion and contraction and electrical isolation.

A stop ring 170 is positioned between the first part 160 and the second part 162 in a sliding path 172 arranged radially outward from an axis 174. In certain embodiments, the stop ring 170 is a split ring. As will be appreciated, the stop ring 170 may be utilized to stop movement of the second part 162 in a first direction 176 and/or a second direction 178. For example, an arm 180 of the second part 162 may contact the stop ring 170 when the second part 162 moves in the second direction 178. Additionally, in the illustrated embodiment, a split flange ring 184 is coupled to the body 182, for example, via the fastener 20 such as a bolt. The inside bore of the split flange ring 184 includes an insulating member 186. In embodiments, the insulating member 186 is made of Teflon™ and secured via glue or some other adhesive.

In the embodiment illustrated in FIG. 8, insulating members 186 are arranged between the first and second parts 160, 162 to thereby block transmission of electrical energy from the first part 160 to the second part 162. For example, the insulating member 186 is arranged on the body 182 between the stop ring 170 and body 182, thereby blocking transmission of energy between the first part 160 and the second part 162. Additionally, insulating member 186 is arranged between the split flange ring 184 and the second part 162, thereby blocking transmission of electrical energy from the first part 160 to the second part 162.

Furthermore, as shown in FIG. 8, a seal 188 is arranged in the sliding path 172 between the first part 160 and the second part 162. As described above, in certain embodiments insulating components may not be pressure sealing. The isolation spool 42 may be utilized to transmit pressurized fluids, and therefore the seal 188 can block leakage of the pressurized fluid. The split ring flange 184 is utilized to block the seal 188 from moving out of the sliding path 172 in the second direction. In this manner, fluid may be transmitted between electrically isolated components.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A system for electrically isolating a wellbore assembly of a wellbore, comprising:

a tubing head having a bore and a load shoulder;

a tubing hanger positioned within the bore of the tubing head, the tubing hanger transferring at least a portion of a downward force of the tubing hanger onto the load shoulder;

a tubing head adapter securing the tubing hanger within the bore of the tubing head, the tubing head adapter removably coupled to the tubing head; and one or more insulating features arranged between the tubing hanger and the tubing head to block contact between the tubing hanger and the tubing head, the one or more insulating features comprising:

a load ring positioned between the tubing hanger and the load shoulder of the tubing head, the load ring receiving the downward force of the tubing hanger, a wear ring positioned radially between the tubing head and the tubing hanger, the wear ring being seated in a recess formed in the tubing hanger, and a retaining ring arranged below the load ring, the retaining ring extending radially outward from a groove formed in the tubing hanger and contacting the tubing head.

2. The system of claim 1, wherein the one or more insulating features further comprises:

a tubing head filler positioned radially between the tubing hanger and the tubing head, the tubing head filler having a load shoulder that substantially corresponds to an upward facing shoulder of the tubing hanger to insulate the tubing hanger from the tubing head adapter.

3. The system of claim 1, wherein the one or more insulating features further comprises:

an adapter ring circumferentially arranged about the tubing hanger, the adapter ring radially positioned between the tubing hanger and the tubing head adapter.

4. The system of claim 1, wherein the one or more insulating features further comprises:

one or more unitized seals positioned radially between the tubing hanger and at least one of the tubing head adapter and the tubing head, the one or more unitized seals blocking radial movement of the tubing hanger relative to an axis of the bore.

5. The system of claim 1, further comprising a tree assembly fluidly coupled to the tubing hanger, the tree assembly comprising one or more valves to isolate pressure within the wellbore.

6. The system of claim 5, further comprising an isolation spool fluidly coupled to the tree assembly, the isolating spool comprising one or more insulating members to electrically isolate the tree assembly from downstream equipment.

7. The system of claim 1, further comprising a bracket electrically coupled to the tubing hanger, the bracket being arranged upstream of the tubing head adapter.

8. The system of claim 7, further comprising tubing arranged within the tubing hanger, the tubing receiving electrical energy from the bracket to transmit the electrical energy to one or more downhole components.

9. The system of claim 1, further comprising an electrical inlet coupled to a casing to transmit electrical energy to the casing, the casing being arranged proximate the tubing head and circumferentially about the wellbore.

10. A system for transmitting electrical energy in a wellbore, the system comprising:

a tubing head;

a tubing hanger positioned on the tubing head, the tubing head holding the tubing hanger on a load shoulder to receive a downward force from tubing coupled to the tubing hanger;

a tree assembly fluidly coupled to the tubing hanger, the tree assembly comprising one or more valves to isolate the wellbore; and one or more insulating features arranged to electrically isolate the tubing hanger from the tubing head, the one or more insulating features comprising:

a load ring positioned between the tubing hanger and the load shoulder of the tubing head, the load ring receiving the downward force of the tubing hanger and electrically isolating the tubing hanger from the tubing head, a wear ring positioned radially between the tubing head and the tubing hanger, the wear ring being seated in a recess formed in the tubing hanger, a tubing head filler positioned radially between the tubing head and the tubing hanger, the tubing head filler positioned upstream of the load ring and the wear ring and electrically isolating the tubing hanger from the tubing head; and a retaining ring arranged downhole of the load ring, the retaining ring blocking downhole movement of the load ring when the tubing hanger is installed within the tubing head.

11. The system of claim 10, wherein the tubing hanger further comprises a large diameter portion having a first section and a second section, the large diameter portion having the recess to receive the wear ring and a reverse taper on the second section.

12. The system of claim 10, further comprising a bracket coupled to the tubing hanger, the bracket transmitting electrical energy to the tubing coupled to the tubing hanger.

13. The system of claim 10, further comprising an isolation spool fluidly coupled to the tree assembly, the isolating spool comprising one or more insulating members to electrically isolate the tree assembly from downstream equipment.

14. The system of claim 10, wherein the one or more insulating features comprises an electrically nonconductive material.

15. A system for transmitting electrical energy to a downhole tool, comprising:

a tubing head;

a tubing hanger coupled to the tubing head, the tubing head receiving a downward force transmitted by at least a section of tubing coupled to the tubing hanger onto a load shoulder formed in the tubing head; and one or more insulating features for electrically isolating the tubing hanger from the tubing head, the one or more insulating features comprising:

a load ring positioned between the tubing hanger and the load shoulder of the tubing head, the load ring receiving the downward force of the tubing hanger, a wear ring positioned radially between the tubing head and the tubing hanger, the wear ring being seated in a recess formed in a large diameter portion of the tubing hanger arranged upstream of the load ring, the large diameter portion having a reverse taper that substantially conforms to a profile of the load ring to thereby transmit the downward force to the load ring, and a retaining ring arranged below the load ring, the retaining ring extending radially outward from a groove formed in the tubing hanger and contacting the tubing head.

16. The system of claim 15, wherein the one or more insulating features further comprises:

a tubing head filler positioned radially between the tubing head and the tubing hanger, the tubing head filler positioned upstream of the load ring and the wear ring and electrically isolating the tubing hanger from the tubing head.

17. The system of claim 15, further comprising a bracket coupled to the tubing head, the bracket transmitting electrical energy to the tubing coupled to the tubing hanger.

18. The system of claim 15, further comprising an electrical inlet coupled to a casing to transmit electrical energy to the casing, the casing being arranged proximate the tubing head and electrically isolated from the tubing hanger via the one or more isolation features.

* * * * *